United States Patent [19]

O'Brien et al.

[11] Patent Number: 4,717,276

[45] Date of Patent: Jan. 5, 1988

[54] END CAP STRUCTURE FOR ATTACHING PAINT SLEEVE TO ROLLER

[75] Inventors: Lawrence B. O'Brien; Walter E. Winston, both of Carmel; Edmund L. Abner, Indianapolis; William L. Buehler, Indianapolis; Walter A. Messick, Indianapolis, all of Ind.

[73] Assignee: Triune Automated Painting Systems, Indianapolis, Ind.

[21] Appl. No.: 779,518

[22] Filed: Sep. 24, 1985

Related U.S. Application Data

[60] Continuation of Ser. No. 565,811, Dec. 27, 1983, abandoned, which is a division of Ser. No. 218,354, Dec. 22, 1980, Pat. No. 4,424,011.

[51] Int. Cl.[4] ..... B05C 17/02; B05C 1/10

[52] U.S. Cl. ..... 401/197; 15/230.11; 401/208

[58] Field of Search ..... 401/197, 208; 15/230.11

[56] References Cited

U.S. PATENT DOCUMENTS

| | | | |
|---|---|---|---|
| Re. 29,311 | 7/1977 | Ritter . | |
| 860,078 | 7/1907 | Binks . | |
| 2,606,334 | 8/1952 | Vaden et al. . | |
| 2,684,497 | 7/1954 | Graham | 401/197 |
| 2,722,029 | 11/1955 | Barnes et al. | 401/197 |
| 2,743,469 | 5/1956 | Ditch . | |
| 2,751,618 | 6/1956 | Pruitt | 401/197 |
| 2,882,541 | 4/1959 | Easley . | |
| 2,965,911 | 12/1960 | Hempel et al. . | |
| 3,134,130 | 5/1964 | Chadwick, II . | |
| 3,230,570 | 1/1966 | Flippen . | |
| 3,231,151 | 1/1966 | Clark et al. . | |
| 3,353,491 | 11/1967 | Bastian . | |
| 3,457,017 | 7/1969 | Bastian . | |
| 3,539,268 | 11/1970 | Stebbins . | |
| 3,549,267 | 12/1970 | Wurzer et al. . | |
| 3,554,659 | 1/1971 | Stokes . | |
| 3,776,645 | 12/1973 | Walker . | |
| 3,826,581 | 7/1974 | Henderson . | |
| 3,877,823 | 4/1975 | Leland . | |
| 3,933,415 | 1/1976 | Woolpert . | |
| 4,072,429 | 2/1978 | Terzian et al. . | |

FOREIGN PATENT DOCUMENTS

| | | | |
|---|---|---|---|
| 1035235 | 8/1953 | France | 401/197 |
| 6405241 | 11/1964 | Netherlands | 15/230.11 |
| 1415788 | 11/1975 | United Kingdom | 401/197 |

*Primary Examiner*—Steven A. Bratlie

*Attorney, Agent, or Firm*—Woodard, Emhardt, Naughton, Moriarty & McNett

[57] ABSTRACT

A paint roller is provided with a removable sleeve receiving a cover having a pile on a stretchable flexible backing and retained by end caps with a bayonet-type connection for convenient installation and removal of the cover. A reversible, speed controllable pump on a hand cart provides paint to the roller from a supply under control of a switch at the roller handle. The roller handle contains a radio transmitter for transmission of pump control signals to a receiver in a pump housing mounted to the hand cart. A peristaltic pump is used for the pumping, and is reversible to facilitate draining of the system back to the paint source. Opening of a door on the pump housing releases pump roller pressure from pump tubing, provides access to pump rollers and pump tubing, and thereby facilitates installation and removal of the pump tubing. Conventional water hose fittings are provided to facilitate cleaning by connection to a hose bib of a domestic water system, if desired. The entire unit is conveniently transportable on a three-wheel cart and provided with a lamp for illuminating the work, and electric power supply for the pump. A spear type intake tube is available for puncturing a paint can and removing paint directly through a punctured lid thereof, without opening the can. The cart includes a well to receive a conventional five gallon paint can, and a well to receive the roller, which well may also be used to facilitate cleaning. There is a swivel coupling on the paint supply line to the roller feed line.

18 Claims, 34 Drawing Figures

151A
230 B
230
230A
151B
23

153
229
152
231
230A
151
230

208
153
156
22
221
ALERT
228
217
FOR.
219
216
REV.
218
214
ON
215
213
OFF
210
209
259
261
152
154
159
158
167
164
166
259
157
261
229
23
231
6B
6B
168
151
21A
151A
21

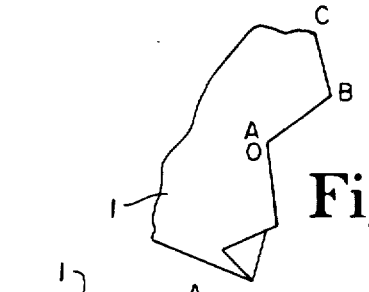
Fig.24D
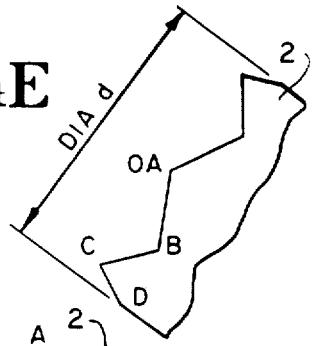
Fig.24E
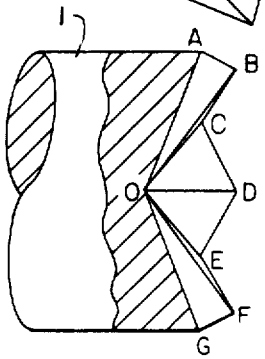
Fig.24A
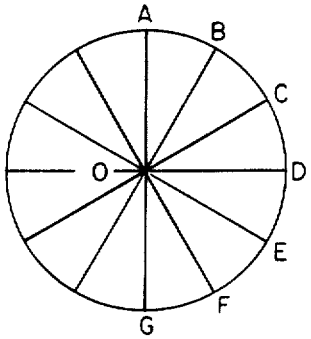
Fig.24B
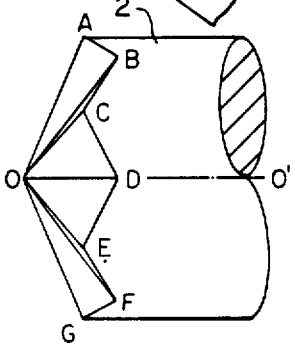
Fig.24C
Fig.24
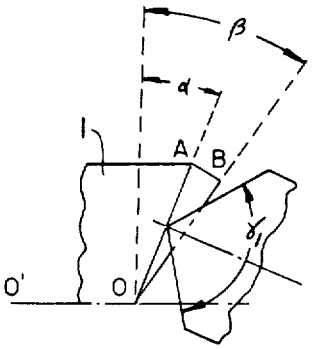
Fig.25A
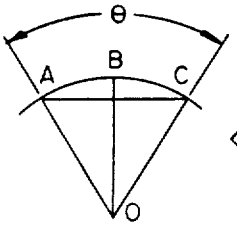
Fig.25B
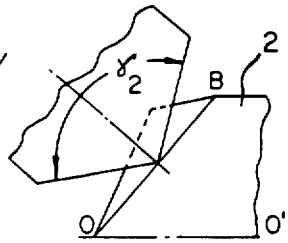
Fig.25C
Fig.25
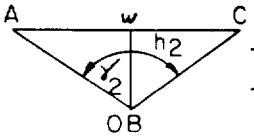
Fig.26

END CAP STRUCTURE FOR ATTACHING PAINT SLEEVE TO ROLLER

This application is a continuation of application Ser. No. 565,811, filed Dec. 27, 1983 now abandoned which is a division of original application Ser. No. 218,354, filed 12/22/80.

BACKGROUND OF THE INVENTION

1. Field of the Invention

This invention relates generally to application of fluidized coatings to rather large areas on surfaces which are usually stationary, typically walls and ceilings of structures. It relates more particularly to a system of maintaining a supply of the coating material to an applicator device constantly, as needed, while the applicator device is in use.

2. Description of the Prior Art

The prior art in painting apparatus is extensive. Dispensers include brushes, pads, rollers, air pressurized sprayers, airless sprayers, and electrostatic dispensers. Perhaps there are others. The various types have advantages and disadvantages. Those of main interest with reference to the present application are those involving contact-type applicators, and especially rollers, brushes and pads. Of the prior art in this area, perhaps the most pertinent is that shown in U.S. Pat. No. 3,457,017 issued July 22, 1969 to James W. Bastian. It discloses a system in which a peristaltic pump, possibly of the type disclosed in his earlier U.S. Pat. No. 3,353,491, is coupled to a roller or pad-type applicator. A motor control switch is mounted on the applicator handle to control the motor for supply of paint from a reservoir to the roller or pad, as needed.

In addition to the prior art cited in the Bastian patent, some additional prior art pertinent to the subject of the present invention, involves internally fed rollers as shown in U.S. patents as follows:

| | | |
|---|---|---|
| 2,743,469 | Ditch | May 1, 1956 |
| 2,882,541 | Easley | April 21, 1959 |
| 3,231,151 | Clark et al. | January 25, 1966 |
| 3,933,415 | Woolpert | January 20, 1976 |

In these patents, the Ditch patent discloses a paint roller internally supplied through the handle tube and having a handle-mounted spring-loaded push button valve 8. O-rings 16 mounted in the hubs 15 seal the hubs to the tube. The hose 5 at the lower end of the handle is intended for connection to a source of supply of paint under pressure.

The Easley patent also discloses a paint roller supplied through the roller mounting tube and through radially extending apertures in a wood, non-absorbent roller core. The paint is supplied to a roller cover made of wool or other material, and the roller mounting tube is connected to a pressurized paint source. O-ring 23 in bearing sleeve 19 prevents leakage of paint outward between the bearings and tube.

The Clark et al. patent discloses the use of a non-absorbent sleeve 74 mounted to the handle and serving as a space occupying member radially distributing paint from the conduit 71 from the handle cylinder 10. In column 4, at lines 39 and following, there is disclosed the concept of limiting the amount of paint inside the roller core to avoid drippage problems. In this instance, pressurization is accomplished by a pressure cylinder which is an integral part of the handle assembly.

In the Woolpert patent, there are roller-type paint applicators in FIGS. 7, 8 and 9, the latter figure showing an edger in contrast to the cylindrical rollers of FIGS. 7 and 8. In FIG. 8, there is shown a sponge roller 114 with a fitted fabric sleeve cover 130, all of which is mounted over a foraminous tube 110. The pressurized paint supply is a diaphragm-type pressurized tank. Faucet water pressure is used to pressurize the paint in the tank. For the FIG. 7 version, a thumb operable button 106 is mounted on the handle to control paint flow. Two valves, 32 and 38, are included for the other embodiments.

Although the above-mentioned Bastian patent does not show a wheeled carriage to enhance portability of the paint reservoir and pump while operating, U.S. Pat. No. 3,230,570 issued Jan. 25, 1966 to Flippen and cited in the Bastian patent, discloses a wheeled carriage including a paint container, a peristaltic pump, and a roller assembly for painting floors, parking lots, driveways, or the like. The Russell and Fisher patents, cited as references in the Flippen patent, also disclose wheeled carriages supporting paint containers (the Russell container being pressurized) and supplying paint to a paint striping brush in the case of Russell, and two discs in the Fisher patent for wet lime marking of athletic fields and the like. While these particular references disclose the use of wheeled carriages for ground marking machines, a fairly recent U.S. Pat. No. 4,072,429, issued Feb. 7, 1978 to Terzian et al. discloses a wheeled carriage having a built-in peristaltic pump for supplying paint from a can through a hose to a wall-painting roller handle. A well is provided in the carriage to receive a paint can from which the intake tube to the pump draws paint. A storage well 124 is provided in the housing for storage of the paint intake tube 44 and the paint delivery tube 56 after use. A bracket 36 is provided on the carriage for hanging the paint roller thereon. A storage compartment 60 in the bottom of the housing is provided on the carriage for storage of the electric cord for the pump motor.

In addition to the above-mentioned prior art, some additional prior art specifically related to internally fed rollers, include the following:

| | | |
|---|---|---|
| 860,078 | Binks | July 16, 1907 |
| 2,606,334 | Vaden et al. | August 12, 1952 |
| 2,965,911 | Hempel et al. | December 27, 1960 |
| 3,134,130 | Chadwick II | May 26, 1964 |
| 3,539,268 | Stebbins | November 10, 1970 |
| 3,549,267 | Wurzer et al. | December 22, 1970 |
| 3,554,659 | Stokes | January 12, 1971 |
| 3,776,645 | Walker | December 4, 1973 |
| 3,826,581 | Henderson | July 30, 1974 |
| 3,877,823 | Leland | April 15, 1975 |
| Re.29,311 | Ritter | July 19, 1977 |

In the above patents, Binks provides a supply of paint to, and surplus removal from, the interior of a roller (FIG. 1), a pad (FIG. 3), and a brush (FIG. 5). Vaden discloses a plastic roller body with a sheepskin cover and an end clamp securing the cover to the roller. It has a delivery control valve push button 16 on the handle.

Hempel et al. discloses a polyurethane stationary wiper core in a self-contained inking roller. Chadwick shows a belt-type roller.

The Stebbins patent discloses a roller having a paint supply tube with an aperture centered longitudinally of the roller. The roller also has annular chambers 50 and 52 within a perforated rigid sleeve or cardboard tube 28 to which the fibers 32 are affixed.

Wurzer et al. discloses an automatically controlled roller coater intended to control flow in response to the rotational speed of the roller. Stokes shows one or two internally fed rollers mounted to paint supply spindles.

Walker shows roller-type applicators in FIGS. 5, 6, 9, 10 and 11, and also various types of pad applicators including pointed pads. Henderson discloses a roller having a plurality of radial ports longitudinally spaced and circumferentially spaced on the cover base 21 to supply the pile 20 of the roller. A rotatable handle is intended to use a cable 36 to control paint flow at the roller.

The Leland patent is one example of a fountain-type paint roller with a supply of paint carried in the roller itself. It is an interchangeable cartridge for a roller handle unit.

The Ritter patent is another example of a roller incorporating a hollow cylinder applicator at the periphery to supply paint to the pile of the roller.

SUMMARY OF THE INVENTION

Described briefly, according to a typical embodiment of the present invention, the painting applicator includes a roller assembly having a support axle, roller manifold assembly rotatably mounted on the axle, perforate support sleeve on the manifold assembly and slidably removable from it, and a removable cover sleeve snugly received on the support sleeve but completely flexible upon removal therefrom to facilitate cleaning. The roller is provided with interior features including outer and inner manifolds facilitating minimal paint volume and weight at the roller, consistent with uniform steady feeding of paint to the roller cover. Further features in the roller facilitate draining of paint therefrom through the paint supply tubing, upon reversal of pumping pressure in the system. Means are provided to permit prolonged periods of nonuse without cleaning. For eventual cleaning and storage, means are provided to facilitate cleaning of the assembly and storage of all of the components.

Supply of paint or other coating material is provided from a pump mounted on a hand cart and having reversible electric motor drive to apply rollers to a compressable tube for pumping purposes. The tube intake is from a conventional paint can received in a nest on the cart with a piercing intake spear through the paint can lid. Discharge is through hoses to a swivel coupling on a handle assembly coupled to the tubular support axle of the roller. One handle part connected to the swivel coupling assembly includes a radio transmitter with manually operable control buttons for controlling pump motor operation, direction and speed. The same controls are provided on the pump housing console on the hand cart. A controller with radio receiver is housed in the pump housing to receive and utilize control signals from the remote control handle.

Access door means on the pump housing provides window observation of the pump tubing when engaged by the pump pressure rollers. Means are provided for release of loading on the pump tubing, including pump roller shifting means operable upon opening the access door, to release pump roller force from the pump tubing. A pump cam contour for smooth operation is provided.

Various fittings used in the paint delivery system from the paint can to the roller are of a size and shape which can be coupled to conventional garden hose fittings in many instances, to facilitate cleaning. Also, provision is made for extension tubing from the handle and swivel coupling to the roller assembly.

BRIEF DESCRIPTION OF THE DRAWINGS

FIGS. 24A–E are a set of views illustrating details of conical face splines.

FIGS. 25A–C are a set of views illustrating the creation of conical face spline teeth.

FIG. 26 is a view in a groove of the conical spline.

DESCRIPTION OF THE PREFERRED EMBODIMENT

Figure 1:
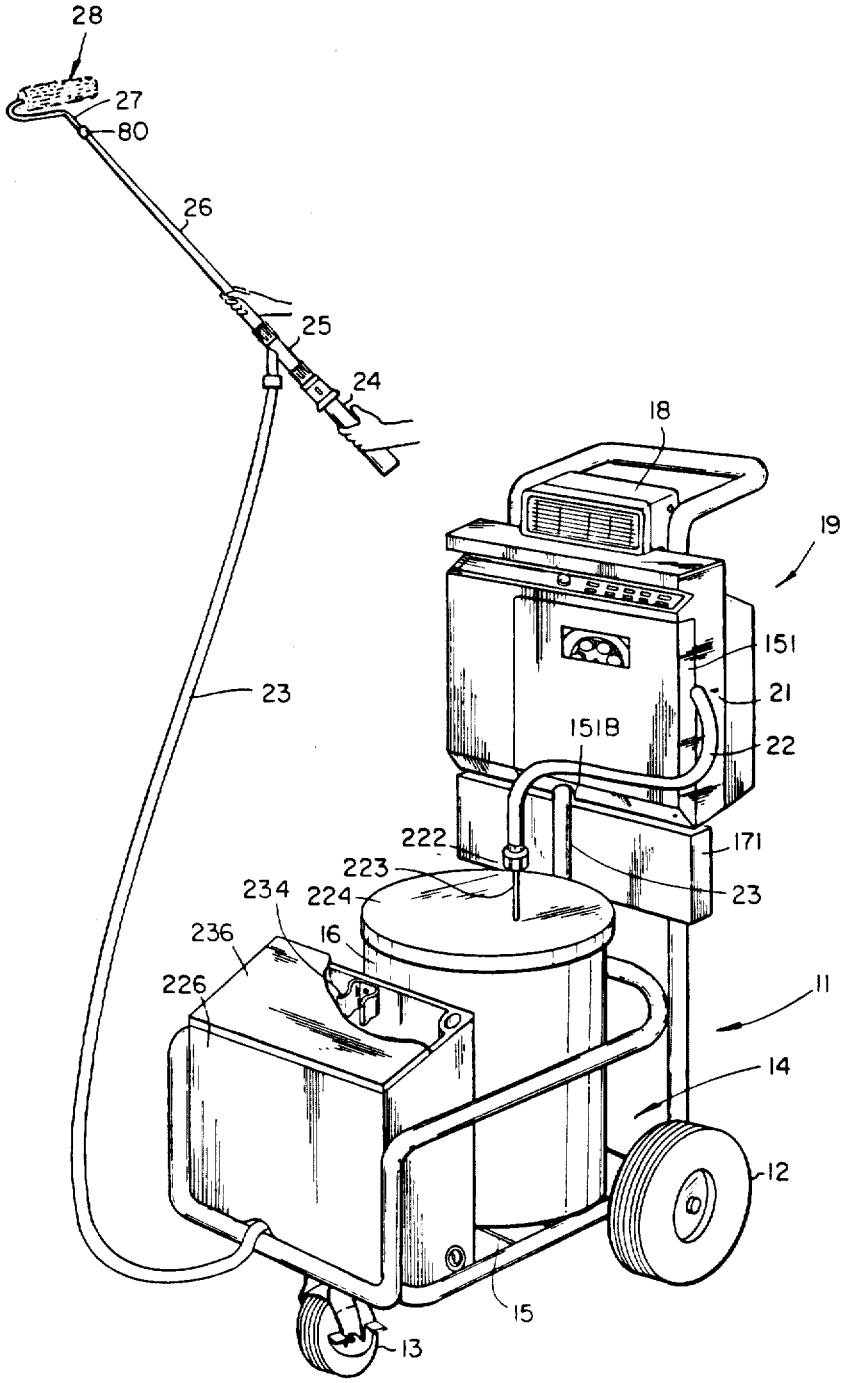
FIG. 1 is a frontal perspective view of a painting applicator with remote supply according to a typical embodiment of the present invention.
Figure 2:
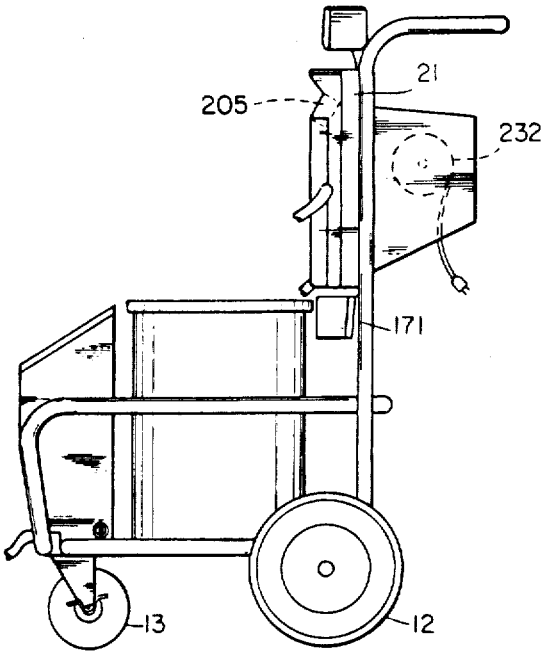
FIG. 2 is a side elevational view thereof.
Figure 4:
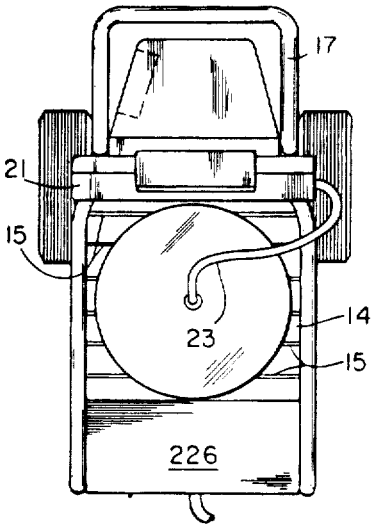
FIG. 4 is a top plan view of the typical embodiment.

Referring now to FIG. 1, the machine includes a three wheeled cart 11 of tubular metal construction with two wheels 12 at one end and a caster wheel 13 at the other. The cart includes a nest 14 (FIG. 4) of small horizontal support rods 15 cooperating with the tubing of the cart frame and receiving a paint can 16 (typically of the five gallon size). Inverted U-shaped handle 17 is provided at rear of the cart and serves as a mount for a pump assembly having a light 18 on it to assist in illuminating the work.

A pump assembly 19 is mounted to the handle 17 and includes a housing 21 with a motor therein driving a pump, the details of which cannot be seen in FIG. 1 but are shown in some of the other drawings.

The pump has an inlet hose 22, and discharge hose 23, the latter being connected to a handle 24 by a swivel coupling assembly 25. A handle extension tube 26 is connected to the swivel coupling assembly 25, and a roller mounting tube 27 is connected to the distal end of tube 26. Roller assembly 28 is mounted to the roller mounting tube.

Figure 7:
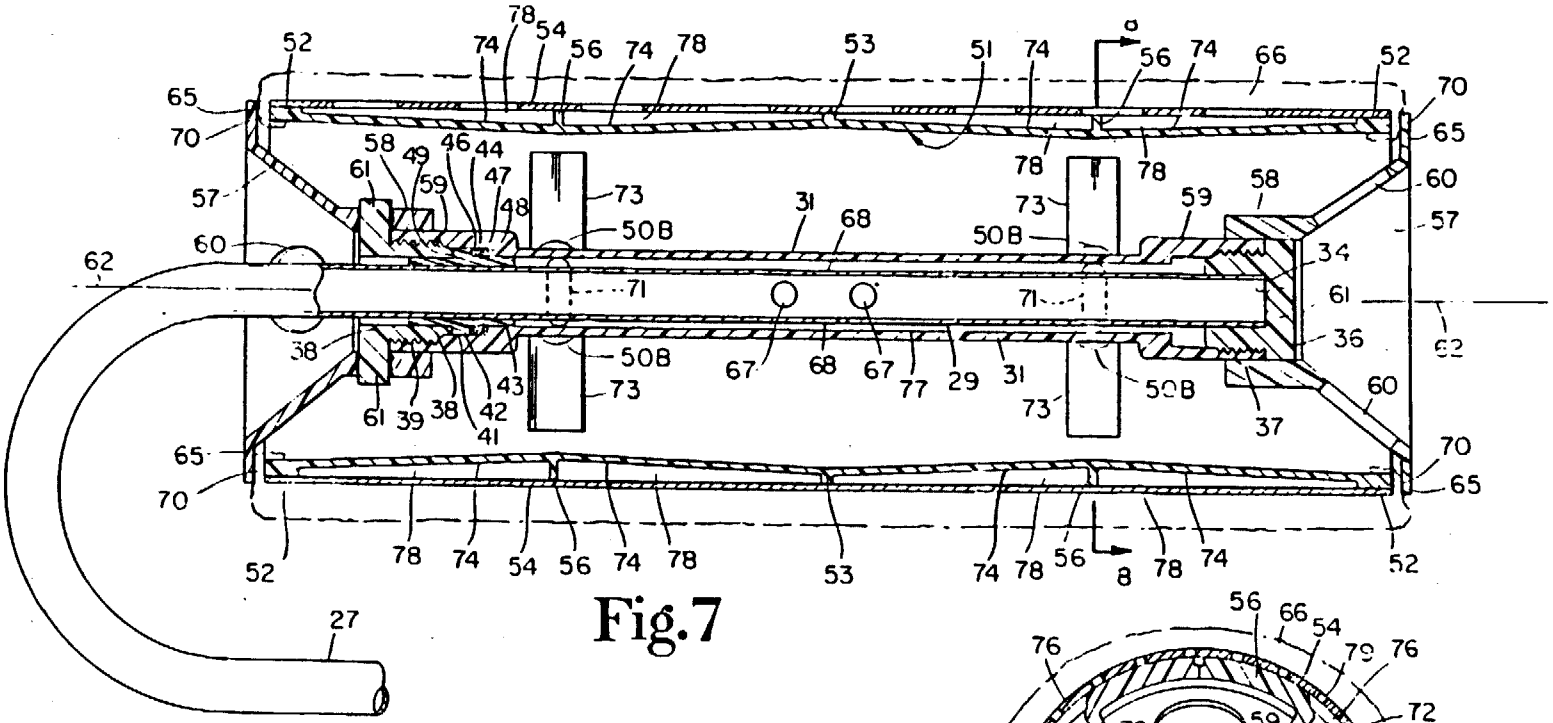
FIG. 7 is a large scale longitudinal section through an applicator roller assembly according to a typical embodiment of the invention.

Since the roller construction is an important feature of the present invention, more detail thereon is shown in FIGS. 7 through 13. Referring first to FIG. 7, the roller support tube 27 has an end portion 29 serving as a roller support axle. A roller inner manifold 31 has low friction bearings 36 and 38 at opposite ends thereof received on the axle for low-friction rotation thereon. Bearing 36 serves also as a roller inner manifold end plug, being threadedly received at 37 in manifold 31 of the roller. At the opposite end of the inner manifold of the roller, bearing 38 serves also as a retainer nut and is threadedly received in manifold 31 at 39. This has an inner end thrust face 41 which engages the flange 42 of a combination stop and seal bushing 43 press-fitted or cemented onto the axle tube 29. A seal 44 is disposed between the face 46 of the flange, and face 47 of the manifold 31 and the inner cylindrical surface 48 of the manifold 31. This seal can be an O-ring, a lip seal of the U-ring type, or preferably Quad-ring type, as desired. The bearings are preferably made of Delrin brand acetyl plastic, or nylon. The axial movement of the roller on the axle is limited by the facing thrust faces 41 of bearing nut 38 and face 49 of flange 42 in one direction, and between the facing thrust face 46 of flange 42 and the combination of the seal 44 and thrust face 48 of the manifold in the other direction. The seal 44 is typically elastomeric and is of a size selected to permit free roller rotation and adequate sealing. Quad-ring size-113 (Aerospace Standard specification AS-568 published by the Society of Automotive Engineers) which is 9/16 inch I.D. and 3/32 inch cross section, has been found suitable. If it is desired not to use the seal as a thrust bearing member, the dimensions can be selected so that the axle tube end, bearing against thrust face 34 of bearing plug 36, will perform the thrust bearing function instead of the seal and manifold thrust face 48.

Figure 8:
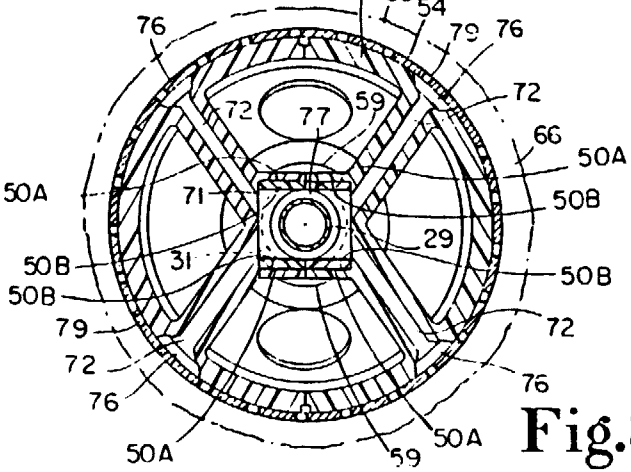
FIG. 8 is a cross-section through the roller assembly taken at line 8—8 in FIG. 7 and viewed in the direction of the arrows.
Figure 9:
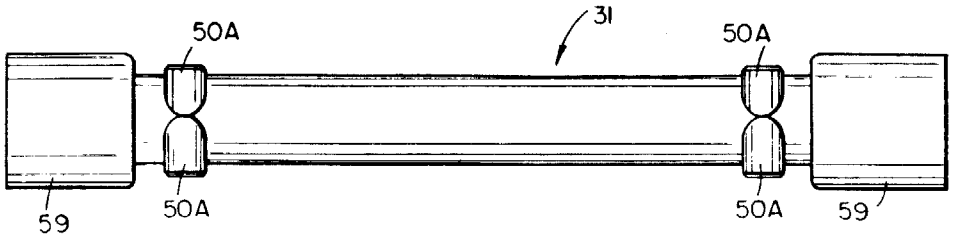
FIG. 9 is a view of the roller inner manifold of the roller assembly of FIGS. 7 and 8.
Figure 10:
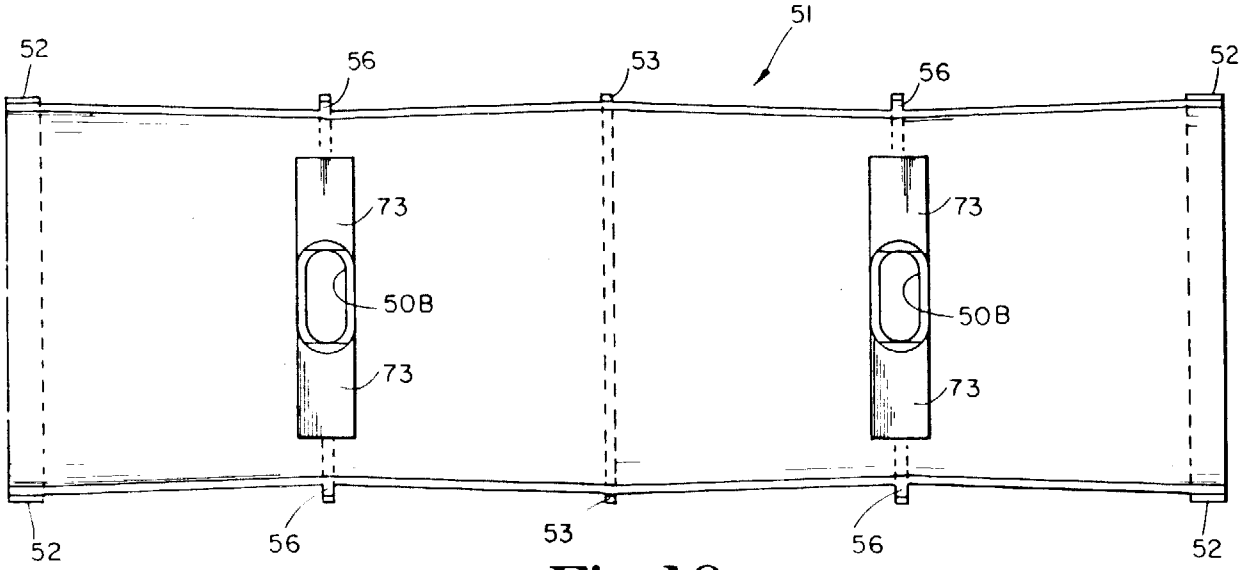
FIG. 10 is a view of the concave face of a roller outer manifold shell, two of which, when assembled to the inner manifold, make a roller manifold assembly. This view is on the same scale as FIG. 9.
Figure 11:
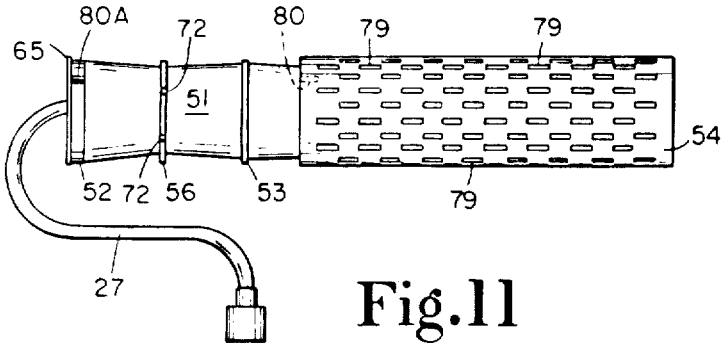
FIG. 11 is an elevational view of the roller assembly with the roller cover completely removed, and the cover support sleeve partially removed from the roller core assembly.

The roller assembly includes an outer manifold 51 in fixed relationship to the inner manifold 31. The fixed relationship is established by boss and socket means which, in the illustrated embodiment, include four hollow bosses 50A on the inner manifold (FIGS. 8 and 9), two near each end, and four sockets 50B on the outer manifold (FIGS. 7, 8 and 10), two near each end. The bosses are snugly fitted in the sockets, and may be glued, or welded, if desired. They must be sealed to each other so as not to leak. The two shells of the outer manifold must also be sealed together so as not to leak. They can be molded in halves, in plastic, and glued or heat, ultrasonic or otherwise welded to the inner manifold and to each other to form an integral unit. This unit has longitudinally spaced circular ribs or flanges including end flanges 52 thereon and intermediate flange 53, all of which are circular flanges. These flanges fittingly receive a cylindrical sleeve 54 thereon which can be manually removed with relatively little force, in an axial direction, if needed, as shown in FIG. 11 where it is about two-thirds removed. Normally it remains in assembly as shown in FIGS. 7 and 8. In addition, there are intermediate circular flanges 56 of the same outside diameter as flanges 52 and 53 and which also serve to support the sleeve 54.

As best shown in FIG. 7, there are two end caps 57, one at each end of the roller. Each of these has a hub 58 which is fittingly received on the outer cylindrical surface 59 of a hub of the manifold assembly. Each nut 36 and 38 has a pair of cylindrical, diametrically opposed, lugs 61 projecting radially outward from the rotational axis 62 of the roller. These receive cam slots 63 (FIGS. 12 and 13) in the end caps. The lugs at the right-hand end in FIG. 7 are shown with their axes perpendicular to the plane of the paper to facilitate further illustration of the structure. The lug 61 is received in the slot 63 in the end cap and serves to tighten the end cap as the cap is turned onto the end of the roller manifold hub 59 in the clockwise direction (as viewed from the right in FIG. 7 and in FIG. 13), while the roller is held stationary. The cam surface 64 of the slot 63 serves to tighten the end cap in the roller. It is a surface generated by a series of arcs, to provide detenting for the lug 61 to impede loosening of the end caps. At the same time, the roller cover 66, which is actually a sleeve, is received between the end of the manifold flange 52 and end cap flange 65 immediately outboard of the conical surface of the end cap at each end, and sandwiched between the manifold flange and the end cap as at 70 so that the roller cover is snugly secured at the opposite ends of the roller, by the end caps. Two holes 60 (FIG. 12) in each end cap can be used to receive a thumb and finger of the user, to facilitate gripping to install and remove end caps. Also, since the end caps have straight, axially extending walls (63A, FIG. 13) at the ends of the cam slots, and which are abuttingly engagable with lugs 61 upon turning the caps in a counterclockwise direction, the end caps can be used as wrenches to unscrew and remove nuts 36 and 38 from the inner manifold to facilitate cleaning when desired.

The roller cover 66 is preferably a completely flexible sock-like unit which may comprise pile on a knitted backing, an open cell foam, or other material which must be strectched slightly to fit over the sleeve 54. The facing material will depend largely on the paint or other coating material being used for rolling onto the wall for coating the wall or other surface, and on the smoothness or roughness of material being coated. The backing will be adapted to accommodate the facing and also have the porosity needed for distributing the paint or other coating material from the sleeve to the facing material.

The sleeve 54 itself is shown in FIG. 11 where it is partially (about two-thirds) removed from the roller core. It is illustrated as a metal or plastic cylinder which is perforated throughout its length and circumference. For example, where the cylinder is three inches in diameter and nine inches long, the perforations may be slots which are rectangular in shape, one-half inch long, three thirty-seconds inch wide and occur at circular spacings of approximately one-half inch. For the integrity of the sleeve and uniformity of coating by the roller, the slots in adjacent rows along the length of the sleeve are staggered so that there is 100% coverage axially with no overlap. Total slot area around the circumference, is preferably uniform throughout the length of the sleeve.

Referring further to FIG. 7, there is shown a pair of apertures 67 in the axle tube, and a pair of apertures 68 also in the axle tube but located to face at 90° with respect to the apertures 67. These are located approximately midway between the ends of the axle tube portion 29. They are midway between the ends of the roller assembly mounted to the axle tube.

As is shown in FIGS. 7 and 8, the inner roller core manifold 31 has generally oblong apertures 71 therein which communicate through passageways 72 in integral spokes 73 to the outer conical surface 74 of the roller core outer manifold 51. Apertures or cutouts 76 (FIG. 8) in the flanges 56 at the outer ends of these passageways permit passage of the paint from the chamber 77 (between the axle tube and inner manifold) through apertures 71 and passageways 72 out into the outer annular chambers 78 in the roller assembly, from which the paint can escape through the perforations 79 in the sleeve 54. It thereby enters the roller cover backing and then the nap of the roller cover. It may be desirable to avoid registry of the perforations 79 with the apertures 76. For this purpose a suitably located inwardly projecting lug 80 on the sleeve is receivable in groove 80A in roller flange 52 to establish and maintain the desired rotational index of the sleeve on the roller outer manifold.

The preferred form of cover for the roller is provided with pile on a knitted backing and is entirely flexible until mounted on the sleeve 54. Accordingly, it can be readily washed in a washing machine or dry cleaned in a dry cleaning machine, or by hand and can be wrung out by hand.

Figure 14:
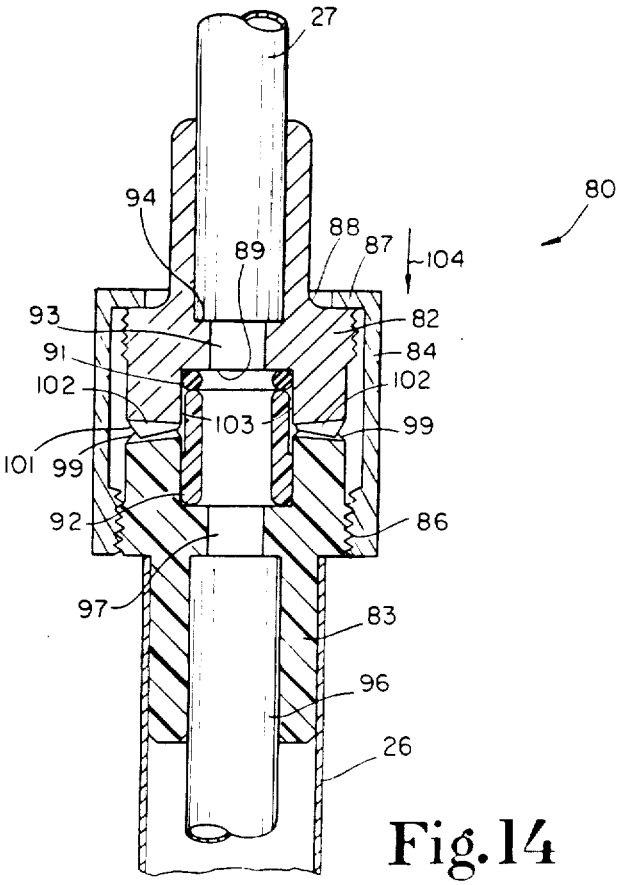
FIG. 14 is an enlarged fragmentary sectional view of the roller mounting tube connection to an extension tube.
Figure 12:
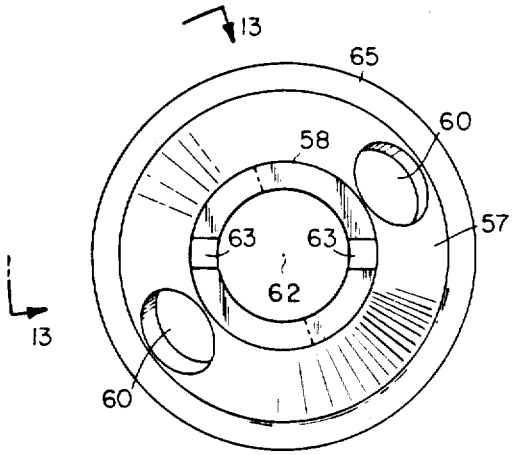
FIG. 12 is an end view (from outside the cone) of a roller end cap on the same scale as FIGS. 7 and 8.
Figure 13:
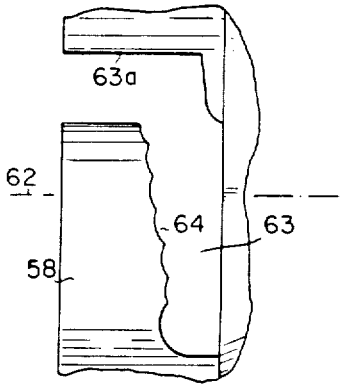
FIG. 13 is a fragmentary side view thereof on a much larger scale, illustrating the detenting cam slot therein.
Figure 15:
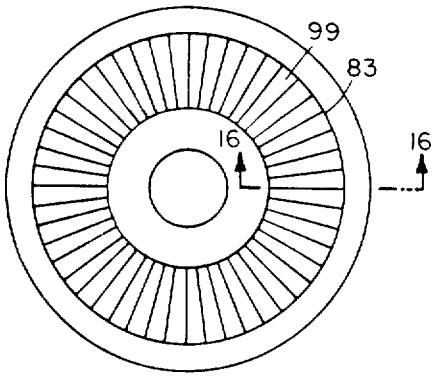
FIG. 15 is a schematic view on a larger scale than FIG. 14 and facing a conical spline array such as may be used in the typical embodiment.
Figure 16:
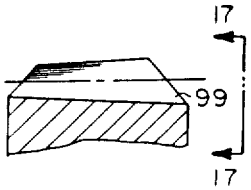
FIG. 16 is a view of one spline taken at line 16—16 in FIG. 15 but on a larger scale and viewed in the direction of the arrows.
Figure 17:
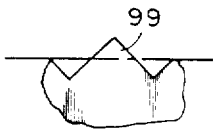
FIG. 17 is an end view of one spline tooth and parts of two others as viewed at line 17—17 in FIG. 16 in the direction of the arrows.

The detailed description of paint delivery from a supply to the roller can begin with FIG. 1, where the roller tube 27 is connected to the extension 26 at a coupling 80. The extension 26 is connected to the applicator handle 24 through swivel coupling assembly 25. FIG. 14 shows details of the coupling 80. It includes connector 82 and connector 83 with a nut 84 threadedly received on connector 83 at 86. This nut has a flange 87 abutting the shoulder 88 on connector 82 and, when threaded onto the threads 86 of connector 83, pulls the sealing surface 89 of connector 82 against the O-ring 91 which, in turn, seals against the end of a tubular bushing 92 press fitted and thereby sealed in connector 83.

A step bore 93 is provided in connector 82 and has a portion of larger diameter which receives the roller mounting tube 27 in a tight fitting relationship, with the tube 27 abutting the shoulder 94 in the stepped bore. Similarly, a paint conveying tube 96 of the extension is tightly received in the step bore 97 of fitting 83.

In order to establish a non-rotational relationship between the handle 24 and the roller mounted on the roller mounting tube 27, mating serrations in the form of conical splines are provided on the facing ends of the connectors 82 and 83. The type of construction is best shown in FIGS. 14, 15, 16 and 17, where spline teeth 99 on the end of connector 83 are received in the spline grooves 101 adjacent spline teeth 102 in connector 82. Accordingly, before assembly of the connectors 82 and 83, the nut 84 is loosely fitting on the connector 82. Then, when the fittings are brought toward each other axially, the desired rotational index between the roller and extension, if any, is established, and the teeth 99 are received in the grooves 101 as the pilot bushing 92 of fitting 83 is received in the pilot bore 103 of fitting 82. With these two pieces engaged in this manner, the nut 84 is advanced in the direction of arrow 104 until the threads of nut 84 begin to be threaded up onto the threads 86 of connector 83. The nut is further threaded onto connector 83 and as it advances in the direction of arrow 104, the splines are further received in the grooves 101, as the O-ring 91 is flattened to establish the fluid-tight seal between fittings 82 and 83.

Figure 18:
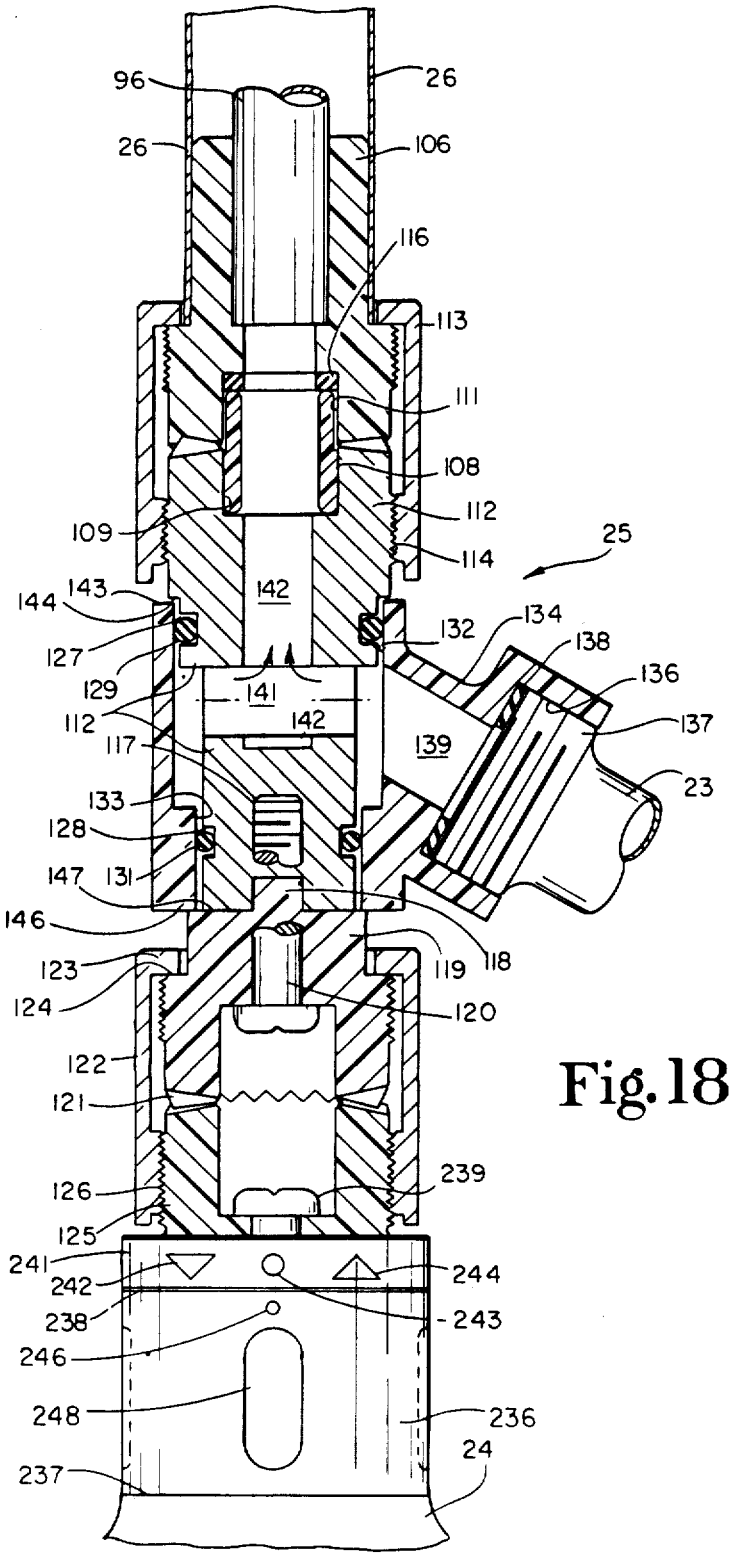
FIG. 18 is a longitudinal section through a typical connection of the extension tube assembly and handle to the swivel coupling assembly.

FIG. 18 shows details of the connection of the extension tube assembly to the swivel coupling assembly, and the swivel coupling assembly to the handle assembly. The extension 26 has a connector 106 secured and sealed thereto at the lower end, the upper end of the tube being secured and sealed to the connector 83 as shown in FIG. 14. The paint tube 96 is press fitted into the bore in the connector 106 and thereby sealed to it as it is in the bore in connector 83 of FIG. 14. A bushing 108 press fitted into the bore 109 of swivel coupling core 112 is received in the bore 111 of fitting 106. The upper end of this core and lower end of the connector 106 have mating conical splines of the same type as described above with reference to FIG. 14. Accordingly, when the nut 113 is threaded onto the threads 114 of the core, the bushing 108 engages the O-ring 116 and provides the seal of the connector 106 to the core 112.

The lower end of the core 112 has a threaded hole 117 on its longitudinal axis. A transverse slot 118 intersecting the longitudinal axis of the core is provided in the lower end. A pan head Phillips screw 120 threaded into hole 117 secures a connector 119 to the lower end of the core. This connector 119 also has a conical spline at the lower end thereof to mate with a conical spline at the upper end of the handle 24, these splines being located at 121. Nut 122 having flange 123 received on shoulder 124 of connector 119 is threadedly received onto the threads 126 of the handle connector 125 at the upper end of the andle assembly 24 and thereby secures the handle assembly through the connector 119 to the core 112.

The swivel coupling core 112 is provided with two grooves, 127 and 128, on its outer cylindrical surfaces. Groove 127 receives O-ring 129, and groove 128 receives O-ring 131. These rings are sealed on the inner cylindrical surfaces 132 and 133, respectively, of the swivel harrel 134. This barrel has a socket 136 receiving a garden hose fitting 137 threaded therein and sealed against a garden hose washer 138. This hose fitting is at the end of the paint supply hose 23 (FIG. 1). The passageway 139 in the barrel communicates through transverse aperture 141 in the core and thence through the central passageway 142 of the core through the upper end thereof and the bushing 108 and the central bore of the fitting 106 to the paint feeding tube 96 of the extension assembly 26. In addition, with the O-rings 129 and 131 secured in the peripheral grooves of the core, and the barrel 134 receiving the O-rings in its inner cylindrical surfaces 132 and 133, the core can be rotated 360° on its axis in the barrel, without any leakage of paint to the exterior. The longitudinal relationship of the barrel to the core is established by the upper end 143 of the barrel engaging the shoulder 144 of the core, and the lower end 146 of the barrel engaging the upper end 147 of the connector 119 bolted to the core.

From the description of the structure in FIG. 18, and by comparison with the description of the structure in FIG. 14, one can recognize that the extension assembly can be omitted, if desired, with the roller support tube being mounted directly to the swivel coupling core by the use of the mating conical splines, the bushing 92 (FIG. 14) engaging the O-ring 116, the nut 84 received on thread 114 of the core, and pulling the assembly tight together. Similarly, any member of extension assemblies may be mated together to form an extension of any desired length.

Referring again to FIGS. 1–6, it was mentioned that there is a pump housing 21. There is a front door provided at 151 with hinges (195, 196 FIG. 19) at the left side whereby the door can be opened to the position shown in FIGS. 6 and 19 where it exposes the pump tube 152 received in a cavity 159 in a stationary wall 153 in the pump housing. One wall of the cavity 159 is a cam surface 154 which generally faces downward and to the right to support the hose against forces directed generally upward and to the left. The pump tube is connected to the inlet hose 22 at a coupling 156, and it is connected to the discharge hose 23 at coupling 157.

A rotor 158 is received in the pump cavity 159 and supports six rollers, three of them being flat faced pressure rollers 161, and three of them being grooved, hose confining and reforming idler rollers 162 of the same outside diameter (O.D.) as the pressure rollers. The rotor 158 rotates about a horizontal axis 163 at its center and which is perpendicular to the plane of operation of the rollers.

Figure 3:
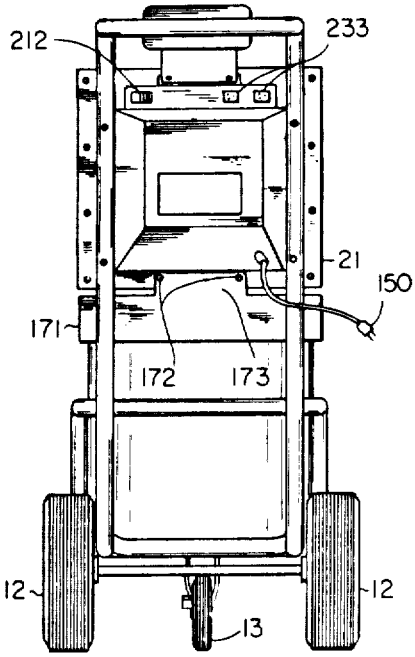
FIG. 3 is a rear elevational view thereof.

The pump cavity is provided with a drain passageway 164 with a lamp 166 focused upward through a window in the bottom of the horizontally extending portion of the drain passageway onto photo cell 167 for detection of passage of any fluid down through the drain passageway, and which would be indicative of a leak in the pump assembly. An open topped safety tray 171 (shown in FIGS. 1–3 and 5) is located under the drain passageway outlet and extends the full width of the pump housing to receive any leakage from passageway 164. It is hung on the back of the housing 21 by a pair of hooks 172 through eyes on a hanger portion 173 of the trough (FIG. 3). A notch 168 in the edge of the door 151 (FIG. 6) accommodates the hose 22, when the door is closed.

Figure 5:
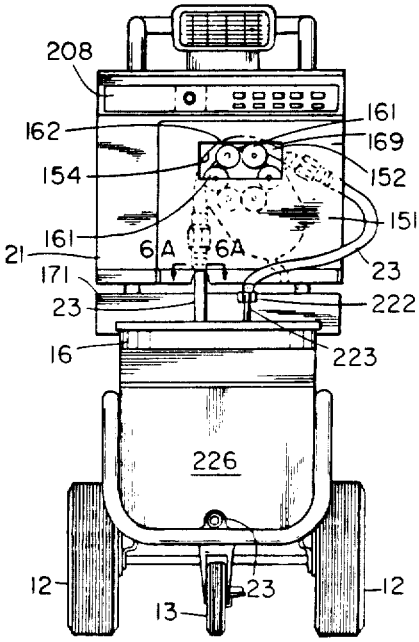
FIG. 5 is a front elevational view thereof with the pump tube access door closed.
Figures 6, 6A, 6B:
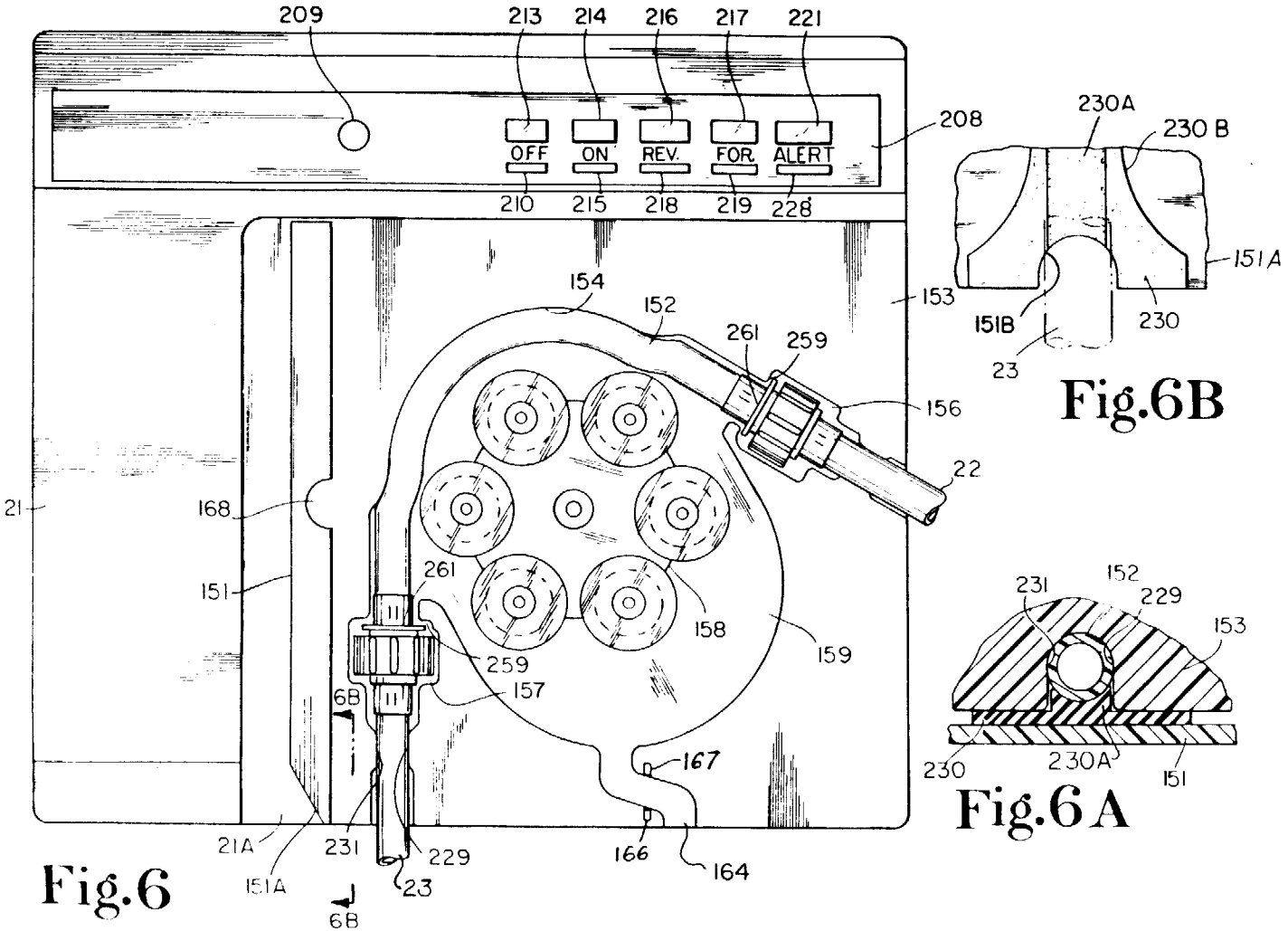
FIG. 6 is a fragmentary enlarged front view with the pump access door open.
FIG. 6A is a fragmentary section taken at line 6A—6A in FIG. 5 and showing the door and pump base sealing the periphery of the pump hose near the discharge end.
FIG. 6B is an elevational view at line 6B—6B in FIG. 6 and viewed in the direction of the arrows to show a fragment of the interior face of the door at the base seal gasket.

As shown in FIG. 5, when the door is closed, one can see a portion of the pump through the window 169. It may be noted in this view that the pressure rollers 161 have forced the lower portion of the pump tube toward the cam surface 154, and the idler roller 162 also is in position of engagement with the pump tube. The shifting of the pump rotor and rollers from the tube compressing position shown in FIG. 5 to the tube release position of FIG. 6 is accomplished simultaneously with the opening of the door in a manner which will now be described with reference to FIGS. 19 through 21.

Figure 19:
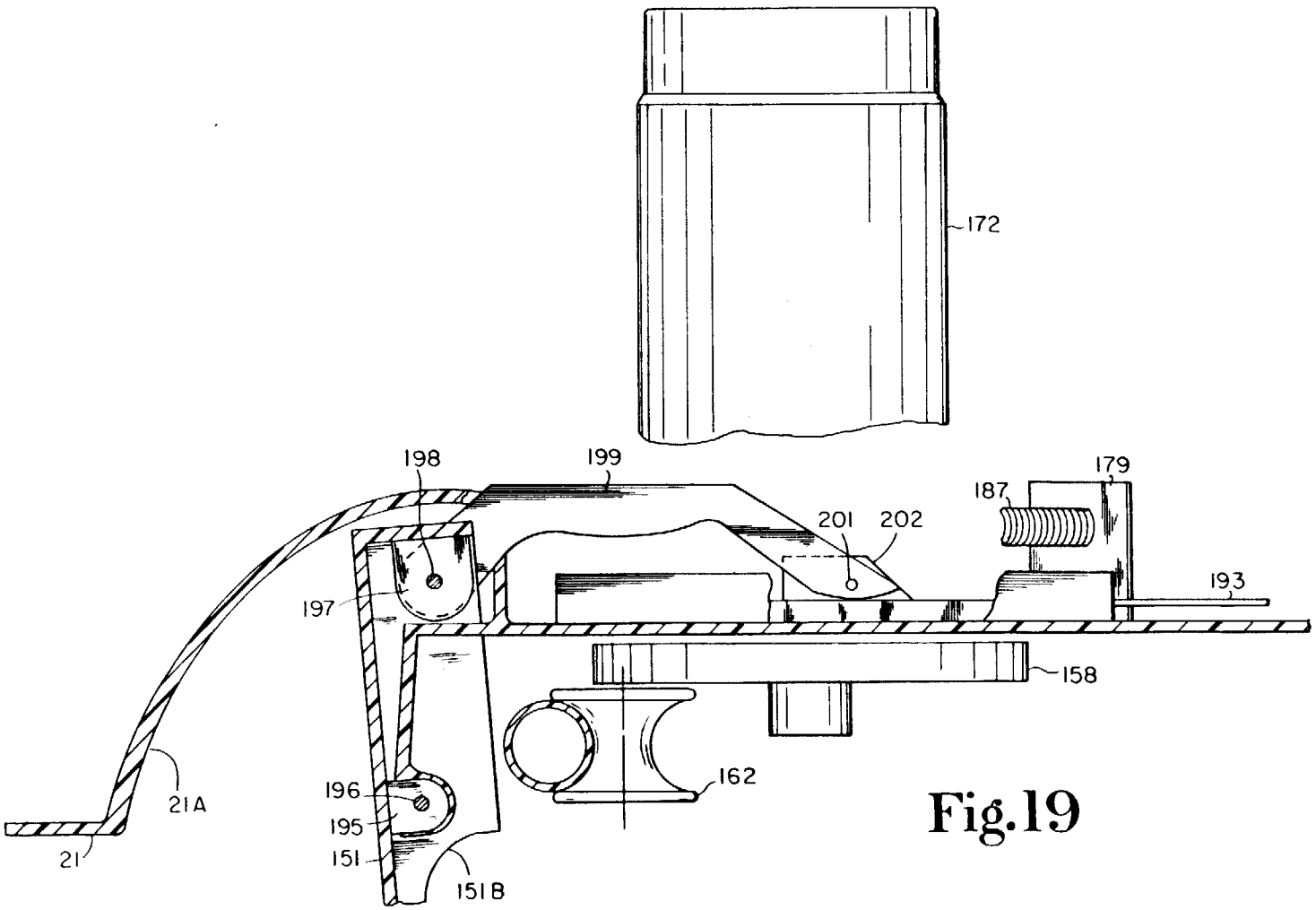
FIG. 19 is a fragmentary top plan view showing the pump motor and mounting portions and door linkage for loading and unloading the pump tube.
Figure 20:
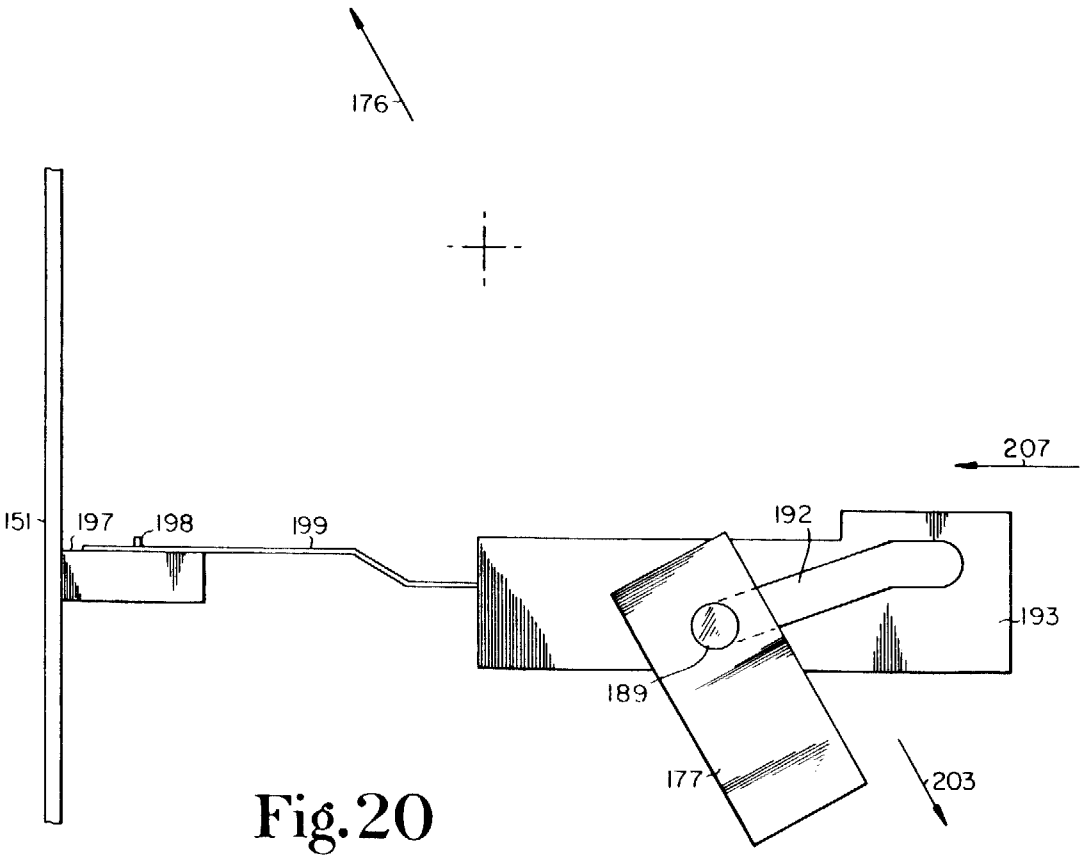
FIG. 20 is a front elevational view of the door linkage.
Figure 21:
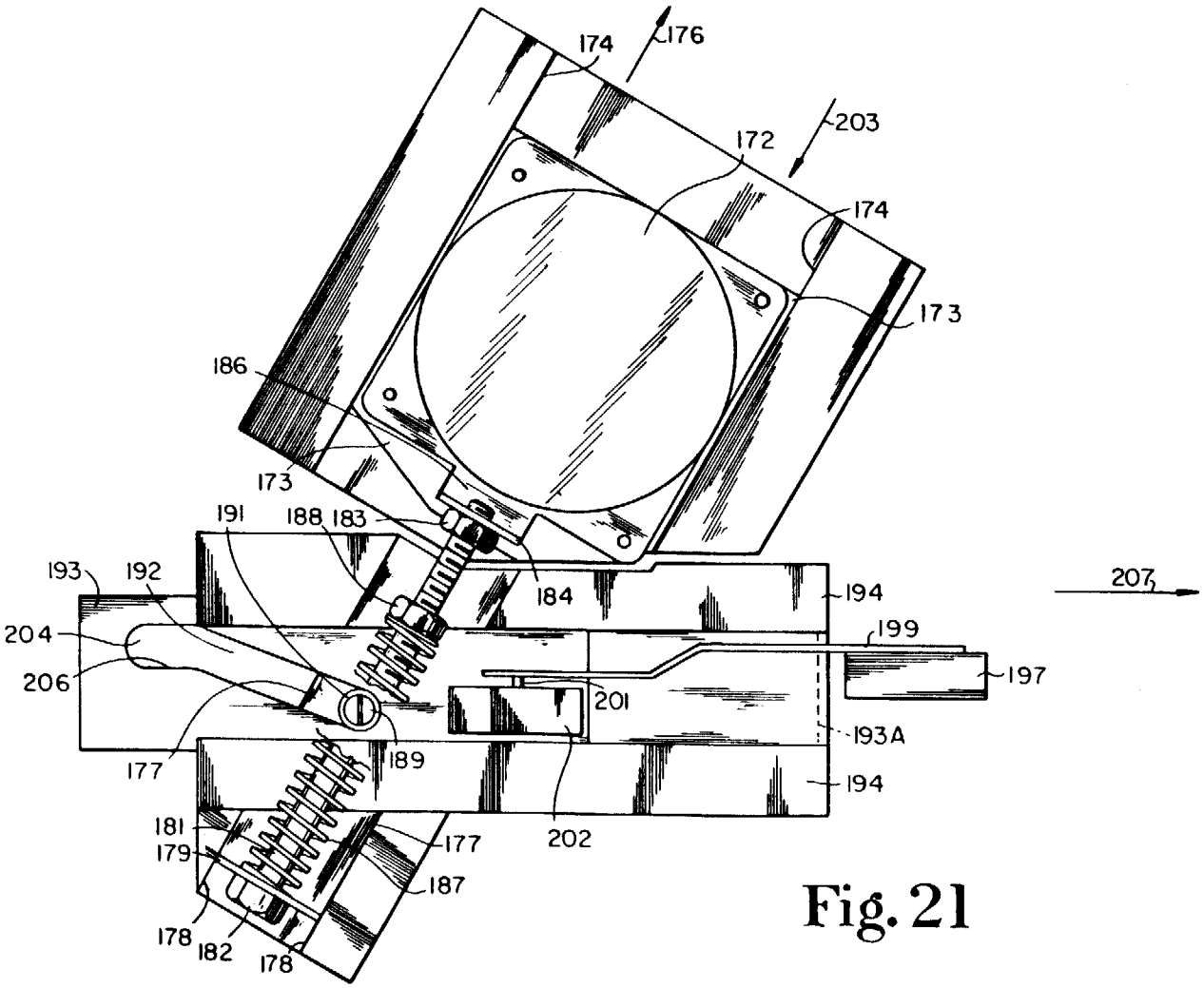
FIG. 21 is a rear elevational view thereof.

Referring now to FIGS. 19, 20 and 21, a reversible motor 172 is mounted to a slide 173 received in tracks 174 so that the motor can be moved in the direction of arrow 176 (FIG. 21). The tracks 174 are in permanent fixed relationship to the cam surface 154. The rotor 158 is secured to the motor shaft so that when the motor is moved in the direction of arrow 176, the rotor is moved in the same direction toward the cam surface 154 to apply the rollers to the pump tube 152.

A slide 177 is received in tracks 178 (FIG. 21) which have a fixed relationship to tracks 174. Slide 177 has a flange 179 with an aperture therein receiving the shank 181 of bolt 182 therethrough. This bolt is threaded into the flange 184 of bracket 186 secured to the slide 173. Nut 183 serves as an adjustment fixing jam nut against flange 184. A coil spring 187 is seated on flange 179, and the upper end of the spring bears on a nut 188 which is threaded on the shank 181 of bolt 182. A pin 189 secured in the slide 177 has a cam follower roller bearing 191 received thereon and which is received in a cam slot 192 in a horizontal slide 193. Slide 193 is received in tracks 194. The tracks 178 and 194 are in fixed relationship to the cam surface 154, as are the tracks 174.

The door 151 has hinge brackets 195 which mount on a vertical hinge pivot axis 196 on the pump housing and which has a fixed relationship to the cam 154. The arm 197 on the rear of the door is fastened by a pin 198 to a link 199, the other end of which is pinned at 201 to a bracket 202 secured to the back of the slide 193.

As the door is opened from the closed position, link 199 pushes slide 193 from the dotted line position 193A to the solid line position. As it does so, the cam follower roller 191 on pin 189 on slide 177 is moved downward in the direction of arrow 203 (FIGS. 20 and 21). As it does so, it pulls slide 177 downward in the same way which, through flange 179 bolt 182, flange 184 and slide 173 on the motor base pulls the motor downward in the direction of arrow 203 to pull the rollers away from the pump tube 152. Accordingly, all of these parts have the position shown in the solid lines in FIGS. 6, 19, 20 and 21. When the door is again closed, the cam follower roller 191 moves up the cam slot 192 until it enters the reverse ramp portion 204 of this cam slot, whereupon the downward resilient force exerted by the pump tube against which the pump rollers are then bearing, tends to urge the pin downward in the reverse ramp portion 204 of slot 192 and thereby hold the door shut. In other words, the force in the direction of arrow 203 against the pump rollers by the pump tube, urges the cam follower roller 191 against the lower face 206 of the cam slot end portion 204, thereby slightly urging the slide 193 in the direction of arrow 207.

Longitudinal adjustment of the nut 188 on the bolt 182 will establish the return force in the spring 187. This can establish the amount of paint pressure which can be developed in the pump tube before the tube will push the pump rollers away in the direction of arrow 203 against the spring force. It thereby limits the pump pressure, even though the door remains shut and the cam follower roller 191 remains in the cam slot end portion 204.

Referring to FIG. 3, switch 212 at the top rear of the housing is for power to the unit. Since this unit may be radio controlled from the handle 24, it is preferable to have a power switch 212 to power up the radio receiver and make power available to the pump motor, subject only to the control functions. The radio receiver and control electronics are integrated on one circuit board 205 (dotted in FIG. 2) behind control panel 208. A pump motor controller 200 by Dart Controls Inc., 5000 W. 106th Street, Zionsville, Ind., Model No. 15DC10 is also located behind control panel 208, and coupled to the control electronics.

Referring now to FIG. 6, the pump control panel 208 on the front of the housing 21 includes a series of buttons and indicator lights and a speed control. The speed control is at 209. It is a rotary knob as for a potentiometer. The two lights to the right of the speed control are for the pump. Light 213 indicates that the pump is off, while light 214 indicates that the pump is on. These have associated switch buttons 210 and 215, respectively under them to achieve these functions.

The next two lights to the right are 216 and 217. Light 216 indicates reversed flow, while light 217 indicates forward flow. The flow direction depends upon the direction of pump operation. Accordingly, the switches below each of these lights are a reverse switch 218 for the reverse flow, and a forward switch 219 for forward flow. The alert light 221 is intended to be illuminated whenever there is a leak such as sensed by the photo cell 167 of FIG. 6, or when some other malfunction is occurring. Switch 228 below light 221 tests the proper functioning of the leak detector and the associated light 221.

Referring again to FIG. 6, it should be understood that the face 153 in the pump housing, which has the cavity 159 therein to accommodate the pump rotor and rollers and the upper portion of which has the cam surface 154 as its wall, also extends to the right-hand and lower marginal edges of that portion of the housing, to thereby receive and pocket the couplings 156 and 157 and the intake hose 22 and outlet hose 23. Accordingly, these components remain securely in place until such time as it is desired to pull them forward out of their nesting cavity to facilitate replacement of the pump tube 152 by disconnecting the couplings 156 and 157. Shoulders 259 of the coupling pockets in face 153 abut the flanges 261 of the male threaded portions of the couplings (which are affixed to the pump tube) to prevent the pump tube from being pulled either way through the cavity 159 during either forward or reverse operation of the pump.

The lower portion 151A of door 151 slopes to the rear so that its lower edge is over the drip trough (safety tray) 171 so that any paint which gets on its inside surface will drain into tray 171. Since this portion of the door slopes to the rear, and hose 23 extends straight down from the housing, a hose clearance notch 151B is provided in the door. A resilient gasket 230 is provided on the inside of the door around and above this notch. It has a key portion 230A (FIGS. 6A and 6B) which extends into the discharge hose groove in housing face 153. It forms and seals around the hose 23 as best shown in FIG. 6A, and seals it at the level where the rest of the circumference of the hose is sealed by the hose groove constriction 229–231, so that any leakage above this level cannot run down the hose. Instead, it will be diverted and run downward and outward along edges 230B of the gasket so it will be further diverted to the drip trough by the rearward sloping wall of the door bottom portion 151A.

The pump housing also includes an electric cord from power plug 150 (FIG. 3) and a cord reel 232 (FIG. 2) behind the panel to the left of the door 151. Electric convenience outlets 233 are also provided on the rear of the housing.

Figure 22:
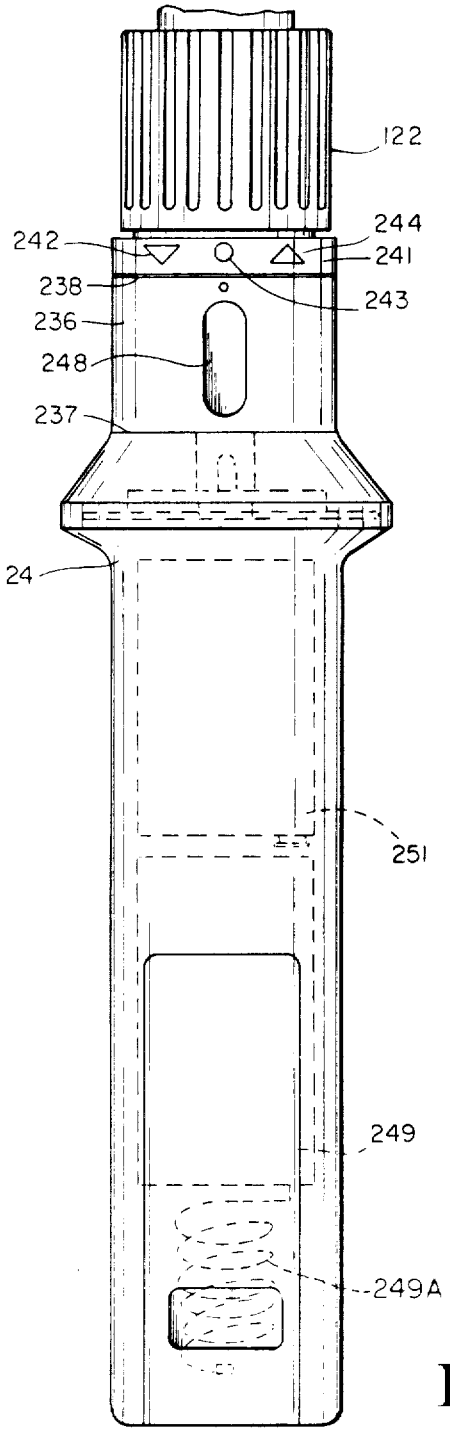
FIG. 22 is a view of the handle assembly.

As shown in FIG. 22, and in part in FIG. 18, the handle 24 includes a switch ring 236 rotatably mounted on the handle and confined between the handle shoulder 237 and the shoulder or collar 238 of the handle connector 125. This connector 125 is secured to the handle by a pan head Phillips screw 239. The flange 241 of the handle connector has symbols 242, 243, and 244 on it. These symbols designate reverse, off, and forward. The switch ring has a symbol 246. It also has a plurality of circularly spaced finger grooves or recesses 248. This switch ring is operable from a rotational index position where the pointer or symbol 246 is aligned with the reverse symbol 242, to the off symbol 243 or to the forward symbol 244. It is detented in each of thse three positions so that once located in one of them, it will remain in such position, until turned to one of the other two positions.

The switch ring thereby controls operation of the transmitter 249 for which electrical supply is provided by the battery 251 and an antenna coil 249A.

As an example of the controls, the transmitter and receiver incorporate a set of integrated circuits, one for the receiver and one for the transmitter. These may be of the type originally designed for remote control toy operation. They operate in the 49 mHz citizen's band. The particular devices used are by National Semiconductor, Sunnyvale, Calif. An LM 1871 is used for the transmitter, and LM 1872 is used for the receiver.

Although the above-mentioned transmitter and receiver devices are designed for continuous carrier operation, in the present case, the transmitter is keyed only when a command is sent, in order to conserve battery power. Also, for control of the receiver in the present case, it is necessary to be sure that, where several painting applicators according to the present invention, are used in the same building, or even in the same room of a building, the transmitter of one will not affect operation of the other. For this purpose, coding is used for each of the control functions. Motorola integrated circuits SC42130 for the receiver, and SC42131 for the transmitter, can be employed for this purpose. These two coding circuits are employed for garage door openers, to differentiate between units for security purposes. Five hundred twelve codes are available. The desired codes can be selected by pencil or probe operated switches associated with the circuits. In use for present purposes, a separate integrated circuit and code selection device can be used for each function to be controlled in the receiver. In the transmitter, one integrated circuit may be used with a switching matrix to program the code differently for each function selected.

The above-mentioned example of components is based upon the desire to use off-the-shelf components in a frequency band available for remote control applications with minimum regulatory restrictions. Other arrangements and components might also be selected and devised to perform the desired functions in the painting applicator.

Since the apparatus of the present invention can be used to apply a variety of materials, it is desirable to obtain the maximum available motor performance. For this purpose, it is desirable to avoid excessive motor loading, not only in the steady state, which is achievable by the above-mentioned spring adjustment nut 188, but also avoiding intermittent or pulse or shock-type loading. The provision of three pressure rollers assists in this effort. However, according to another feature of this invention, it can be achieved by careful attention to the pump cavity.

Figure 23:
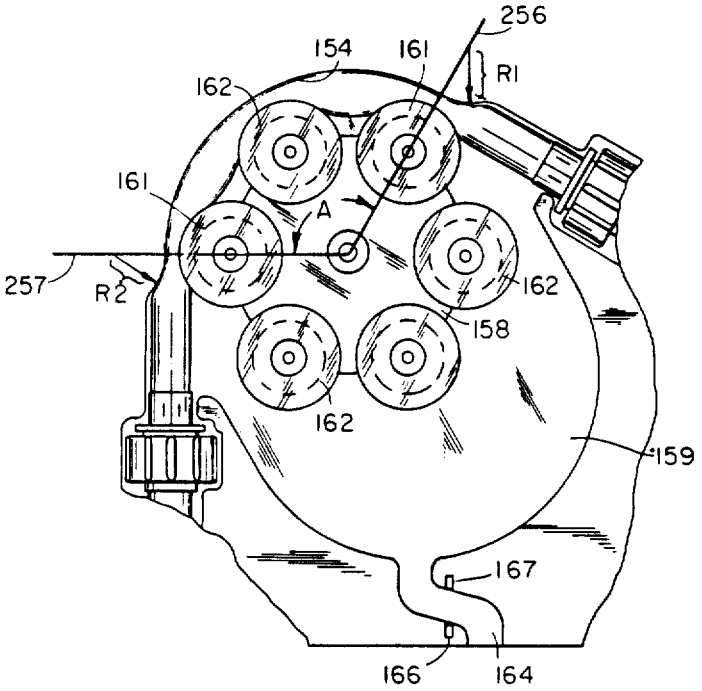
FIG. 23 is a fragmentary front view of the pump on the same scale as FIG. 6 but omitting the door and showing the pressure rollers engaged with the pump tube as for pumping.

Referring particularly to FIG. 23, it is shown that the pump cam 154 is normal to radii 256 and 257 which are 120° apart and intersect the center lines of two pressure rollers 161. In order that the compression of the pump hose by one roller commences at the same time that release of pressure commences with the pressure roller immediately ahead of it, the entrance to the cam surface is formed with a radius (R1, FIG. 23) equal to the radius of the pressure rollers 161. Likewise, at the departure or exit end of the cam, the surface normal to the radius of the cam diverges outward according to a curve whose radius R2 is equal to the radius of the pressure rollers. A similar technique would be used if the pump were provided with more or less pressure rollers. For example, if the pump were provided with four pressure rollers, then the contour of the cam surface at the entrance and exit would be at radii equal to those of the pressure rollers centered on radii from the center of the roller motion arc at an included angle between adjacent rollers of 90°, and tangent to the cylindrical portion of the cam arc at points located at opposite ends of a sector having a 90° included angle and centered on the axis of rotation of the rotor mounting and drive disc. In the present example, where there are three pressure rollers, the included angle between the pressure rollers ("A") is 120°. Therefore, the centers of the radii of the entrance and exit arcs are on radial lines 120° apart.

OPERATION

In operation, the various components are assembled in much the manner described above. In the illustrated version, a single extension handle 26 is employed. It is connected to the roller mounting tube at the upper end, and to the swivel coupling assembly at the lower end, the swivel coupling assembly is connected to the control handle. The pump intake hose 22 is connected by a suitable conventional garden hose coupling 222 to a combination puncture spear and intake tube 223 in the lid 224 on the paint can 16. This spear may have a sharp end so that it can be actually punched directly through the top of the can of paint which has already been stirred or shaken on a power operated shaker or otherwise. Once the roller is installed, the painter is ready to paint.

During the painting operation, the power switch 212 is placed in the on condition, and the painter can then start the pump running by pushing the on button 215 under light 214. He pushes button 219 to provide forward pump operation. He can keep the paint flowing to the roller as long as the pump is running. The speed of the pump, and therefore the volume of delivery, can be controlled by the speed control knob 209. All of these functions except the power switch 212 and speed control can likewise be controlled by the handle 24, there being appropriate function controls on the handle for this purpose. Speed control at the handle is planned.

During a pause in painting, the off switch 210 under the off light 213 can be pushed. This stops the flow of paint. The configuration of the roller, which contains very little paint that has not been absorbed by the roller cover, prevents paint from dripping when the pump stops. If the painting is to be interrupted for a prolonged period of time or under circumstances where very wet and/or heavy coats are being applied, the motor can be switched to the reverse position by pushing the button 216 and the on button 215. Thereupon the pump will proceed to drain the entire system back into the paint can. At this particular time, the configuration of outer manifold cones in the roller itself aids materially in removing all of the paint from the chambers in the roller so that there is very little left. To assist in this function, if desired, the roller can be rolled up and down against a surface to be sure that all the paint has had an opportunity to enter the passageways 72, chamber 77, and axle tube 29 through the ports 67 and 68. Then, the roller itself can be placed in the hanger 234 in the "caddy" 226 in the front of the cart, and the hinged cover 236 closed until such time as the painter is ready to resume painting. Since the entire system is sealed and the cover closed on caddy 226, the painting may be interrupted for hours or days without having the paint dry, and painting may be resumed at any time.

If the painting will be terminated, the paint can be pumped back into the paint can as previously described. Then the entire system can be flushed by moving the paint intake spear from the paint can and inserting it in a can of appropriate cleaning solvent, (water in the case of water soluable paints) removing the roller cover and replacing the roller in the same can and operating the system to circulate solvent through the system in the normal direction. Another possibility is to reverse the pump operation, and then pump solvent from the roller end into the can.

In instances where it may be desirable for economy purposes, to use a unidirectional motor, the effect of reversing the pump can be achieved by reversing the locations of hoses 22 and 23 on their respective couplings 156 and 157, or by threading the pump tube through the pump in the opposite direction, and running the pump in the normal direction.

By making the coupling 222 to the intake spear in a size compatible with conventional garden hose fittings, the system can be drained and flushed without even running the pump motor, by simply connecting the coupling 222 to a hose bib. For this purpose, normally the pump tube 152 is either removed from the pump, or at least the load of the rollers against the tube is released by opening the door.

Referring now to FIG. 24, it comprises five views. FIG. 24A shows a fragment of a part 1 having a conical spline, the teeth being shown by cutting a fragmentary section on the line AG in FIG. 24B. FIG. 24B is an end view with alphabetical legends for relation of that view to FIG. 24A and to the part 2 of FIG. 24C which shows the mating spline. FIG. 24D is a view of part 1 shown in FIG. 24A with the view being taken along the line AO in FIG. 24A. Similarly, FIG. 24F is a view of part 2 shown in FIG. 24C with the view being taken along the line BO.

The conical face spline is designed to positively align the two parts. The parts have a number "n" of vee shaped teeth formed so that contact is made over the entire side of the teeth. Teeth may be relieved in either the root or crown to eliminate interference. With the mating parts 1 and 2 of FIGS. 24A and 24C, respectively, with axis OO' and diameter d and teeth formed with vee cutters having included angles $\gamma 1$ and $\gamma 2$, reference is now made to FIG. 25. In FIG. 25, FIG. 25A shows a portion of part 1 of FIG. 24A and FIG. 25C shows a portion of part 2 of FIG. 25A, but with the part turned on its axis through an angle equal to 180° divided by the number of teeth. FIG. 25B shows an end view of one tooth referring to an angle $\theta$. In that figure, the angle $\theta$ equals 360/n measured in a plane perpendicular to the line OO'. The length w of cord $$AC = PD = d \sin\left(\frac{180}{n}\right) = w.$$

The milling cutter for part 1 is C1 and the cutter for part 2 is C2.

Referring now to FIG. 26, which illustrates the groove shape between teeth, and also the shape of the milling cutter C2 of FIG. 25C, $h_2$ is the perpendicular distance from the midpoint of cord AC in part 2, to line OB. Therefore, $$h_2 = \frac{w}{2} \cot\left(\frac{\gamma_2}{2}\right) \text{. Also } h_1 = \frac{w}{2} \cot\left(\frac{\gamma_1}{2}\right).$$

Let $\alpha$ be the angle that line OA forms with a plane perpendicular to line OO', and $\beta$ be the angle line OB forms with a plane perpendicular to line OO' (FIG. 25A), then $$h_1 = \frac{\frac{d}{2} \cos\left(\frac{\theta}{2}\right) \sin(\beta - \alpha)}{\cos \beta};$$

$$h_2 = \frac{\frac{d}{2} \cos\left(\frac{\theta}{2}\right) \sin(\beta - \alpha)}{\cos \alpha} \text{ and}$$

$$\tan\left(\frac{\gamma_1}{2}\right) = \frac{\tan\left(\frac{180}{n}\right) \cos \beta}{\sin(\beta - \alpha)};$$

$$\tan\left(\frac{\gamma_2}{2}\right) = \frac{\tan\left(\frac{180}{n}\right) \cos \alpha}{\sin(\beta - \alpha)}.$$

For example, to make both coupling parts identical and for a 24 tooth spline, let $\alpha = -\beta$ then $\gamma 1 = \gamma 2$; set $\gamma = 90°$, n=24, then $$\tan(45°) = \frac{\tan(9°) \cos \beta}{\sin(2\beta)}, \text{ or } \sin \beta = \frac{\tan 9°}{2 \tan 45°}$$

and $\beta = 3.77°$. For the present invention, the preferred embodiment is a 20 tooth spline. Therefore, if we set $\gamma = 90°$ and n=20, then $$\sin \beta = \frac{\tan(7.5°)}{2 \tan(45°)}; \beta = 4.54°.$$

While the invention has been illustrated and described in detail in the drawings and foregoing description, the same is to be considered as illustrative and not restricted in character, it being understood that only the preferred embodiment has been shown and described and that all changes and modifications that come within the spirit of the invention are desired to be protected. In that regard, where the expressions "paint" or "painting" appear herein, they should be understood to embrace any fluidized materials regardless of whether they can be technically considered to be paint.

What is claimed is:

1. A painting roller apparatus comprising:
roller body means having an axis and rotatably mountable on an axle for rotation on said axis;
a flexible cover snugly received on and supported by said body means;
cover retainer means on at least one end of said body means and operable upon turning said retainer means relative to said body means about said axis for clamping said cover against said body means on said one end; and
cooperating detent means on said retainer means and said body means and having successive detents to provide successive detenting action upon said turning to impede unintentional turning of said retainer means relative to said body means, said retainer means being readily lockable to and releasable from said body means when desired for, respectively, clamping and unclamping said cover.

2. The apparatus of claim 1 wherein:
said retainer means include a clamping ring portion extending out from said axis substantially to the maximum radius of said body means from said axis at said one end, whereby said ring portion axially clamps said cover against th end of said body means at said one end to prevent migration of paint from said cover around the end of said body means and inward therefrom toward said axis.

3. The apparatus of claim 2 wherein:
said retainer means include two cover retainers, one at each end of said body means, the said clamping ring portion being on one of said retainers, the other retainer also having a clamping ring portion axially clamping the ring of the other retainer against the other end of said body means.

4. The apparatus of claim 3 wherein:
said detent means include cam lugs in said body means cooperating with apertures in said retainers for quick lock and release of said retainers to quickly clamp and unclamp said cover.

5. A painting roller comprising:
roller body means having a rotational axis;
a perforate sleeve received on said body means extending coaxial therewith and cooperating with said body means to form a shallow annular chamber between said sleeve and said body means;
a flexible cover snugly received on and supported by said sleeve and removable from said sleeve for cleaning said cover independent of said sleeve; and
a pair of cover retainer caps, one of said caps securing said cover to said body means at each end of said body means;
said caps having hubs with successive detent notches therein,
said body means having lugs projecting into said notches locking said caps to said body means.

6. The roller of claim 5 wherein:
said detent notches are on an edge of a cam surface having a slope such as to enable said caps to lock to said body means upon less than a full turn of said cap relative to said body means about a common axis of said body means and said retainer caps;
said projecting lugs being disposed on body end plugs threaded into opposite ends of said body means.

7. In a painting system having paint applicator means, a paint source, and conduit means from the source to the applicator means, the improvement in said applicator means comprising:

a roller support axle;

a roller body assembly having a longitudinal axis and rotatably mounted on said axle;

a removable applicator member snugly received on said body assembly and supported thereon and operable to receive paint from passages in said body assembly for distribution through the outer surface of said applicator member to a surface to be painted;

applicator retainer means securing said applicator member to said body assembly and including a first retainer cap received in one end of said body assembly, and having a portion engaged to said applicator member and clamping said applicator member; and interengaging bayonet-type rotary interlock means on said cap and said body assembly adjacent said one end of said body assembly to facilitate mounting and locking said retainer cap in said one end of said body assembly, said interlock means being arranged whereby mounting and locking are achieved by turning said retainer cap relative to said body assembly less than one full turn about said axis.

8. The improvement of claim 7 wherein:

said interlock means include a cam surface in said cap and a lug in fixed relationship to said body assembly and receiving said cam surface thereon.

9. The improvement of claim 8 and further comprising:

a body retainer for retaining said body assembly on said axle, said body retainer being threadedly received into said body assembly and thereby secured in said body assembly, said lug radially projecting from said body retainer into engagement with said cam surface.

10. The improvement of claim 9 wherein:

said body retainer is a thrust and radial load bushing fittingly and rotatably received on said axle.

11. The improvement of claim 10 wherein:

said body retainer has a cylindrical outer mounting surface receiving a cylindrical hub of said cap thereon, said cam surface being on the edge of a slot located in said cylindrical hub.

12. The improvement of claim 10 wherein:

said applicator member is a flexible cover; and said retainer cap has a radially extending flange clamping said flexible cover to said one end of said body assembly.

13. The improvement of claim 7 wherein:

said applicator member is a flexible cover, the improvement further comprising;

a second retainer cap received in the other end of said body assembly and having a portion engaging said cover and clamping said cover;

interengaging bayonet-type rotary interlock means on said second cap and said body assembly to tighten said second cap into clamping engagement of said cover with said body assembly at said other end of said body assembly;

said interlock means including cam surfaces and lugs.

14. The applicator means of claim 13 wherein:

said caps are identical and each has a conical web; and finger holes are located in said conical webs of said caps to facilitate rotation thereof with respect to said body assembly.

15. The improvement of claim 13 wherein:

said cam surfaces have detents thereon for detenting on said lugs as said caps are tightened into the ends of said body assembly by rotating said caps about the axis of said axle, while said body assembly is held stationary to enable progressive tightening of said caps, with the detents engaged by the lugs holding the caps in discrete rotational positions relative to said body assembly.

16. The improvement of claim 13 and further comprising:

body retainers threadedly received into said body assembly near both ends of said body assembly, said lugs being on said body retainers and projecting radially outward therefrom into engagement with cam surfaces on said caps.

17. The improvement of claim 16 wherein:

said body retainers are inboard and outboard radial bushings fittingly and rotatably received on said axle, the outboard bushing being at the end of said axle.

18. The applicator means of claim 16 wherein:

said cam surfaces have slots associated with them, each slot having a wall parallel to the axis of threads on the body retainer and on the side of the slot engageable with said lugs upon turning said caps in a direction to unscrew the retainer from the body assembly, so as to make said caps useful as a wrench for removing said body retainers from said body assembly.

* * * * *

UNITED STATES PATENT AND TRADEMARK OFFICE

CERTIFICATE OF CORRECTION

PATENT NO. : 4, 717, 276

DATED : January 5, 1988

INVENTOR(S) : Lawrence B. O'Brien; Walter E. Winston; Edmund L. Abner; William L. Buehler; and Walker A. Messick It is certified that error appears in the above-identified patent and that said Letters Patent is hereby corrected as shown below:

Page 1, at [75] Inventors: change "Walter A. Messick" to --Walker A. Messick--.

Column 16, line 27, change "th" to --the--.

Signed and Sealed this

Twenty-eighth Day of June, 1988

*Attest:*

*Attesting Officer*

DONALD J. QUIGG

*Commissioner of Patents and Trademarks*